US009981487B2

(12) United States Patent
Oki

(10) Patent No.: US 9,981,487 B2
(45) Date of Patent: May 29, 2018

(54) PRINTING APPARATUS

(71) Applicant: SEIKO EPSON CORPORATION, Tokyo (JP)

(72) Inventor: Naoki Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/449,624

(22) Filed: Mar. 3, 2017

(65) Prior Publication Data

US 2017/0253052 A1 Sep. 7, 2017

(30) Foreign Application Priority Data

Mar. 4, 2016 (JP) ..... 2016-041858

(51) Int. Cl.
*B41J 11/02* (2006.01)
*B41J 11/00* (2006.01)

(52) U.S. Cl.
CPC ..... *B41J 11/002* (2013.01); *B41J 11/0045* (2013.01)

(58) Field of Classification Search
CPC ..... B41J 11/002; B41J 11/0015; B41J 11/057
See application file for complete search history.

(56) References Cited

U.S. PATENT DOCUMENTS 9,573,390 B2 * 2/2017 Sasaki ..... B41J 11/002
2015/0009269 A1 1/2015 Sasaki

FOREIGN PATENT DOCUMENTS

| | | |
|---|---|---|
| JP | 10-217572 | 8/1998 |
| JP | 2001-033929 | 2/2001 |
| JP | 2001-080802 | 3/2001 |
| JP | 2004-315205 | 11/2004 |
| JP | 2012-121192 | 6/2012 |
| JP | 2014-104604 | 6/2014 |
| JP | 2015-013446 | 1/2015 |
| WO | 2011-135737 | 11/2011 |

OTHER PUBLICATIONS

Computer-generated translation of JP 2015-13446, published on Jan. 2015.*

* cited by examiner

*Primary Examiner* — Huan Tran
(74) *Attorney, Agent, or Firm* — Workman Nydegger

(57) ABSTRACT

A printer includes a printing section configured to perform printing on roll paper, a transport surface (hot plate) where the roll paper on which printing has been performed is transported, and a heater unit (heater) for heating the transport surface. The stated transport surface includes a plurality of projections with which the roll paper makes slide contact.

14 Claims, 7 Drawing Sheets

PRINTING APPARATUS

BACKGROUND

1. Technical Field

The present invention relates to printing apparatuses.

2. Related Art

An ink jet printer that forms (prints) an image by ejecting ink onto a print medium is known as a printing apparatus, for example. As a print medium on which an ink jet printer performs printing, roll paper that is supplied in a state of being wound in a roll form can be cited, for example, in addition to cut paper such as copy paper or the like.

JP-A-2001-80802 discloses an image forming apparatus (printing apparatus) characterized in that air flows in a transport direction on a surface of a discharge guide configured to guide roll paper on which printing has been performed to proceed in a discharge direction (characterized in that such discharge guide is provided). According to this image forming apparatus, an air layer is formed between the roll paper and the surface of the discharge guide, which prevents the generation of static electricity caused by friction between the roll paper and the surface of the discharge guide. As a result, the roll paper is prevented from being attracted to the surface of the discharge guide due to the static electricity, and is smoothly guided to proceed in the discharge direction.

SUMMARY

However, with the image forming apparatus disclosed in JP-A-2001-80802, in the case where the roll paper is to be dried by heating after image formation (after printing), particularly when it is attempted to dry the roll paper by heating the surface of the discharge guide which guides the roll paper, there arises an issue that the roll paper cannot be effectively dried due to the air layer formed between the roll paper and the surface of the discharge guide. To deal with this, although a method in which the air layer is formed with hot air has been considered, there is also an issue that the roll paper cannot be efficiently dried because the method brings about a large energy loss such as the hot air being spread to the periphery of the apparatus or the like.

An advantage of some aspects of the invention is to solve at least part of the above issues, and the invention can be realized in the following application examples or embodiments.

First Application Example

A printing apparatus according to a first application example includes a printing section configured to perform printing on a print medium; a transport surface where the print medium on which printing has been performed is transported; and a heater unit for heating the transport surface, and the above-mentioned transport surface has a plurality of projections with which the print medium makes slide contact.

According to this application example, because the heated transport surface on which the print medium is transported is so configured as to include the plurality of projections with which the print medium makes slide contact, that is, because a contact area between the print medium and the transport surface becomes smaller, the generation of static electricity caused by friction is suppressed in comparison with a case where the print medium makes slide contact with the entirety of the transport surface with which the print medium overlaps. In addition, the attraction due to static electricity is suppressed at the same time.

Further, because the print medium on which printing has been performed is heated by making slide contact with (making contact with) the projections of the heated transport surface, the print medium can be more efficiently dried.

As a result, with the structure in which the print medium is more efficiently dried by causing the print medium to make contact with the heated transport surface, the transport (discharge) of the print medium can be smoothly carried out while suppressing the print medium being attracted to the transport surface by the static electricity.

Second Application Example

In the printing apparatus according to the above application example, the projections are separated from each other in a planar view of the transport surface in a second direction intersecting with a first direction in which the print medium is transported, and are continuous in a projective view when seen in the first direction.

According to this application example, in a projective view when seen in the first direction in which the print medium is transported, the projections of the heated transport surface are so configured as to be continuous in the second direction intersecting with the first direction in which the print medium is transported. With this, the entire surface of the print medium makes slide contact with one of the projections by the print medium passing through the transport surface. In other words, drying operation in which uneven drying is decreased can be carried out because the entire surface of the print medium makes contact with the projections of the heated transport surface.

Third Application Example

In the printing apparatus according to the above application example, a side surface configuring the projection and positioned on the opposite side to the first direction is so formed as to approach a top surface of the projection with which the print medium makes slide contact as it progresses in the first direction.

According to this application example, the side surface configuring the projection and positioned on the opposite side to the first direction is so formed as to approach the top surface of the projection with which the print medium makes slide contact as it progresses in the first direction. That is, even if an end portion of the print medium transported in the first direction makes contact with the side surface configuring the projection and positioned on the opposite side to the first direction, the side surface of the projection functions as a rake-face for scooping up the end portion of the print medium, whereby the print medium can be smoothly transported (discharged) without being caught.

Fourth Application Example

In the printing apparatus according to the above application example, the projection is so formed as to extend both in a direction intersecting with the first direction in which the print medium is transported and in a direction intersecting with a direction orthogonal to the first direction in a planar view of the transport surface.

According to this application example, the projection is so formed as to extend, in a planar view of the transport surface, both in a direction intersecting with the first direction in which the print medium is transported and in a direction intersecting with a direction orthogonal to the first direction, that is, the projection is so formed as to extend in an oblique direction in the transport surface. With this, a situation where an end portion of the print medium being transported is caught by the side surface configuring the projection and positioned on the opposite side to the first direction is suppressed, thereby making it possible to smoothly transport (discharge) the print medium.

Fifth Application Example

In the printing apparatus according to the above application example, a side surface configuring the projection and positioned on the opposite side to the first direction includes a guide surface by which, in the case where a corner of an end on the first direction side of the print medium being transported in the first direction makes contact with the stated guide surface, the corner is biased in a direction toward an outer side of the print medium in the second direction.

According to this application example, the side surface configuring the projection and positioned on the opposite side to the first direction includes the guide surface by which, in the case where a corner of an end on the first direction side of the print medium being transported in the first direction makes contact with the guide surface, the corner is biased in a direction toward the outer side of the print medium in the second direction. That is, even in the case where a corner of an end of the print medium being transported in the first direction makes contact with the side surface configuring the projection and positioned on the opposite side to the first direction, if the side surface in contact with the corner is the above-described guide surface, the print medium can be smoothly transported (discharged) because the corner of the end portion of the print medium is biased in a direction toward the outer side of the print medium.

Sixth Application Example

A printing apparatus according to a sixth application example includes a printing section configured to perform printing on a print medium; a transport surface where the print medium on which printing has been performed is transported while making slide contact with the transport surface; and a heater unit for heating the transport surface, and the above-mentioned transport surface has a plurality of recesses.

According to this application example, because the heated transport surface on which the print medium is transported while making slide contact with the transport surface is so configured as to include the plurality of recesses, an area where the print medium makes slide contact, that is, a contact area between the print medium and the transport surface becomes smaller. With this, the generation of static electricity caused by friction is suppressed in comparison with a case where the print medium makes slide contact with the entirety of the transport surface with which the print medium overlaps. In addition, the attraction due to static electricity is suppressed at the same time.

Further, because the print medium on which printing has been performed is heated by making slide contact with (making contact with) the heated transport surface, the print medium can be more efficiently dried.

As a result, with the structure in which the print medium is more efficiently dried by causing the print medium to make contact with the heated transport surface, the transport (discharge) of the print medium can be smoothly carried out while suppressing the print medium being attracted to the transport surface by the static electricity.

Seventh Application Example

In the printing apparatus according to the above application example, a side surface configuring the recess and positioned on the side of a first direction in which the print medium is transported is so formed as to approach the transport surface with which the print medium makes slide contact as it progresses in the first direction.

According to this application example, the side surface configuring the recess and positioned on the first direction side is so formed as to approach the transport surface with which the print medium makes slide contact as it progresses in the first direction. That is, even if an end portion of the print medium being transported in the first direction makes contact with the side surface configuring the recess and positioned on the first direction side, the stated side surface of the recess functions as a rake-face for scooping up the end portion of the print medium, whereby the print medium can be smoothly transported (discharged).

Eighth Application Example

In the printing apparatus according to the above application example, the recess is so formed as to extend both in a direction intersecting with the first direction in which the print medium is transported and in a direction intersecting with a direction orthogonal to the first direction in a planar view of the transport surface.

According to this application example, the recess is so formed as to extend, in a planar view of the transport surface, both in a direction intersecting with the first direction in which the print medium is transported and in a direction intersecting with a direction orthogonal to the first direction, that is, the recess is so formed as to extend in an oblique direction in the transport surface. With this, a situation where an end portion of the print medium being transported is stuck in the recess is suppressed, thereby making it possible to smoothly transport (discharge) the print medium.

Ninth Application Example

In the printing apparatus according to the above application example, a side surface configuring the recess and positioned on the first direction side includes a guide surface by which, in the case where a corner of an end on the first direction side of the print medium being transported in the first direction makes contact with the stated guide surface, the corner is biased in a direction toward an outer side of the print medium in a second direction intersecting with the first direction.

According to this application example, the side surface configuring the recess and positioned on the first direction side includes the guide surface by which, in the case where a corner of an end on the first direction side of the print medium being transported in the first direction makes contact with the guide surface, the corner is biased in a direction toward the outer side of the print medium in the second direction. That is, even in the case where a corner of an end of the print medium being transported in the first direction makes contact with the side surface configuring the recess and positioned on the first direction side, if the side surface in contact with the corner thereof is the above-described guide surface, the print medium can be smoothly transported (discharged) because the corner of the end portion of the print medium is biased in a direction toward the outer side of the print medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments in which the invention is implemented will be described with reference to the drawings. Note that the following are merely application examples and are not intended to limit the invention. Further, in the following description of the drawings, scales that are different from an actual scale are used in some cases so as to facilitate the understanding of the description. As for coordinates given to the drawings, a Z-axis direction corresponds to an up-down direction, a positive Z direction corresponds to an upper direction, a Y-axis direction corresponds to a front-rear direction, a positive Y direction corresponds to a front direction, an X-axis direction corresponds to a right-left direction, a positive X direction corresponds to a left direction, and an X-Y plane corresponds to a horizontal plane.

Note that, even if expressions, such as "orthogonal", "parallel", "constant" and so on, that are supposed to be strictly understood are used in the following descriptions, these expressions not only indicate the strict meanings of "orthogonal", "parallel" and "constant", but also indicate broader meanings thereof in which a permissible level of error with respect to the performance of the apparatus, a permissible level of error that may be generated during the manufacture of the apparatus, and the like are included.

First Embodiment

Figure 1:
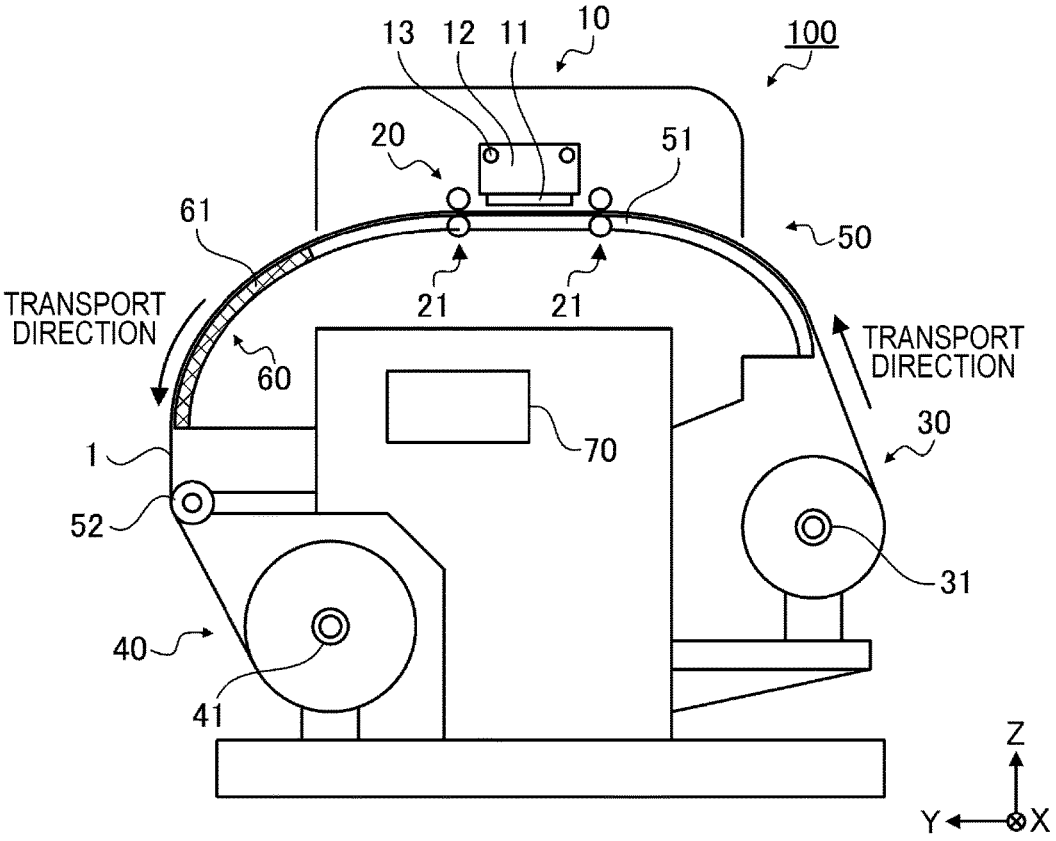
FIG. 1 is a side view schematically illustrating a printer as a printing apparatus according to a first embodiment.
Figure 2:
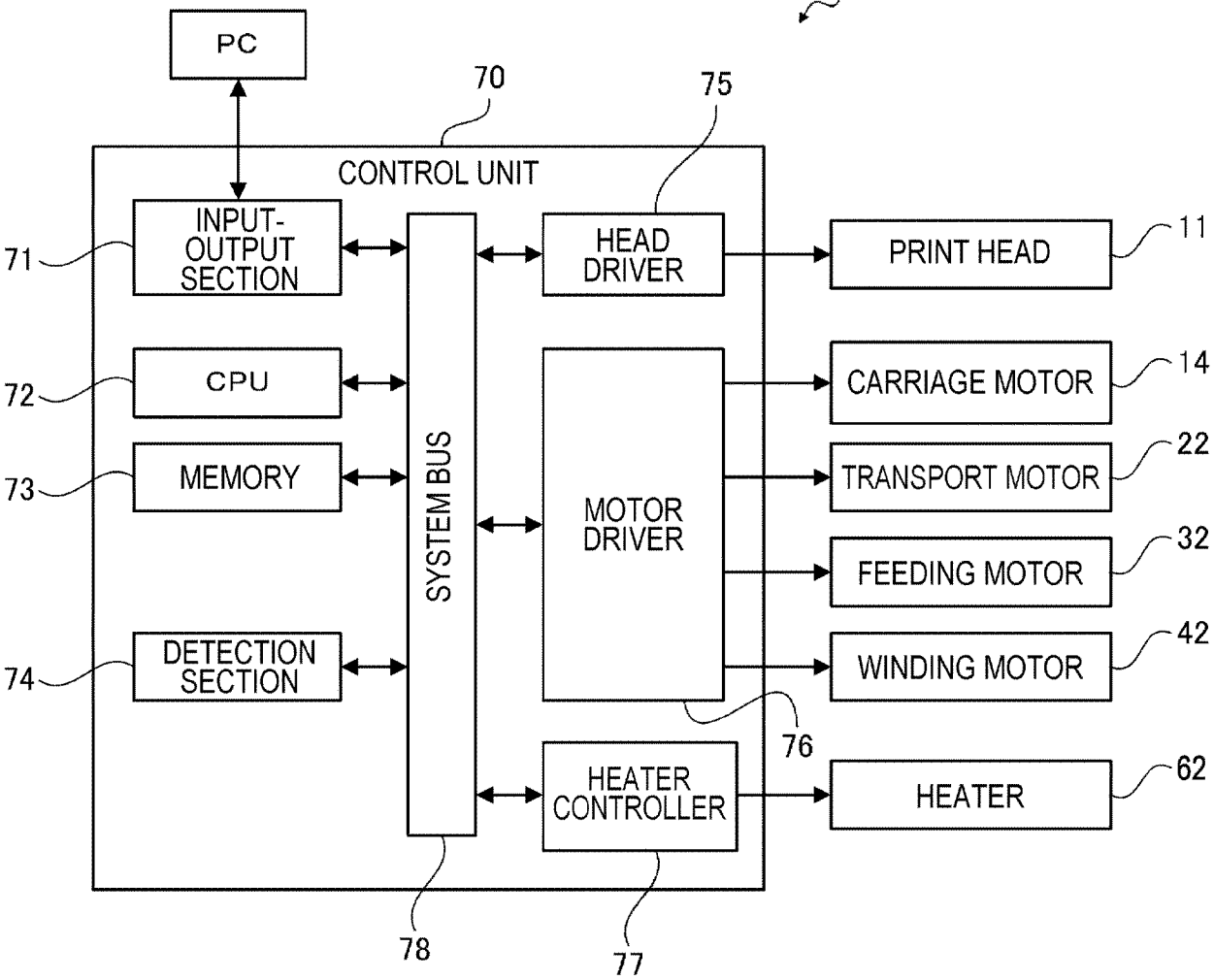
FIG. 2 is a block diagram of a printer.

FIG. 1 is a side view schematically illustrating a printer 100 as a "printing apparatus" according to a first embodiment. FIG. 2 is a block diagram of the printer 100.

The printer 100 is an ink jet printer capable of printing an image on roll paper 1 that is supplied as a "print medium" in a state of being wound in a roll form.

The printer 100 includes a printing section 10, a transport section 20, a supply section 30, a winding section 40, a transport path 50, a drier 60, a control unit 70, and the like.

The roll paper 1 is supplied from the supply section 30, and is transported through the transport path 50 to be accommodated in the winding section 40 via the printing section 10 when printing is performed.

As the roll paper 1, for example, wood free paper, cast paper, art paper, coat paper, synthetic paper, or a film formed of PET (polyethylene terephthalate), PP (polypropylene) or the like can be used.

The printing section 10 is configured of a print head 11, a carriage 12, a guide shaft 13, and the like. The print head 11 is an ink jet head provided with a plurality of nozzles through which ink droplets are ejected. The guide shaft 13 extends in a scanning direction (the X-axis direction in FIG. 1 and the same direction as a "second direction" in this application of the invention) intersecting with a transport direction as a "first direction" in which the roll paper 1 is moved. The carriage 12 has the print head 11 mounted thereon, and moves back and forth (moves while scanning), along the guide shaft 13, driven by a carriage motor 14 (see FIG. 2) which is controlled and driven by the control unit 70.

The control unit 70 controls to repeat an ejection operation in which ink droplets are ejected from the print head 11 while moving the carriage 12 in the scanning direction and a transport operation in which the roll paper 1 is moved in the transport direction by the transport section 20 in an alternate manner, thereby forming (printing) a desired image on the roll paper 1.

Although the printing section 10 is configured of a serial head moving back and forth in the scanning direction in this embodiment, the printing section 10 may be configured of a line head in which nozzles through which ink is ejected are aligned in a direction intersecting with the transport direction across a range where the roll paper 1 can be set. Further, a printing apparatus equipped with a printing section other than the above-discussed so-called ink jet print head may be provided.

The transport section 20 is a transport mechanism to move the roll paper 1 in the transport direction in the printing section 10, and is configured of a drive roller 21 accompanied by a nip roller, and the like. The roll paper 1 is transported by driving the drive roller 21 with the roll paper 1 nipped between the drive roller 21 and the nip roller.

The drive roller 21 is driven by a transport motor 22 (see FIG. 2) which is controlled and driven by the control unit 70.

The transport section 20 is not limited to the configuration of the above-discussed rollers, and may be configured of a transport belt or the like, for example.

The supply section 30 is a storage section where the roll paper 1 before printing is stored, is positioned on the upstream side of the printing section 10 in the transport path 50, and includes a feeding shaft 31 and the like.

The feeding shaft 31 is rotated by a feeding motor 32 (see FIG. 2) which is controlled and driven by the control unit 70, and feeds out the set roll paper 1 toward the printing section 10 disposed on the downstream side of the supply section 30.

The winding section 40 is an accommodation section configured to wind the roll paper 1 on which printing has been performed and accommodate the roll paper 1 in a state of being wound in a roll form, is positioned on the downstream side of the printing section 10 in the transport path 50, and includes a winding shaft 41 and the like.

The winding shaft 41 is a rotational shaft rotated by a winding motor 42 (see FIG. 2) which is controlled and driven by the control unit 70, and winds the roll paper 1 transported through the printing section 10 while taking the rotational shaft as a shaft center.

The transport path 50 is a transport route for transporting the roll paper 1 from the supply section 30 to the winding section 40 via the printing section 10, and is configured of a medium supporter 51 including a platen to support the roll paper 1 in a print region of the printing section 10, a rotational bar member 52, and the like.

The rotational bar member 52 extends across a range in a width direction of the roll paper 1 where the roll paper 1 can be set, between the winding section 40 and an end portion on the downstream side of the transport route configured by the medium supporter 51. The rotational shaft of the rotational bar member 52 is fixedly supported by a main body of the printer 100, and the rotational bar member 52 is rotated along with movement of the roll paper 1 which is in contact with the rotational bar member 52, thereby supporting the movement of the roll paper 1.

The drier 60 is a portion for drying the roll paper 1 on which printing has been performed, and is positioned on the downstream side of the printing section 10 and on the upstream side of the winding section 40 in the transport path 50. To be specific, in the case where aqueous ink or thermosetting ink is used as ink for printing, the drier 60 heats, during the transport of the roll paper 1, the roll paper 1 onto which ink droplets have been attached so that the ink is thermally dried or thermally cured. Within the medium supporter 51 configuring the transport path 50, a region supporting the roll paper 1 at a position on the upstream side of the winding section 40 and on the downstream side of the printing section 10 is configured as the drier 60.

The structure of the drier 60 will be explained later.

As shown in FIG. 2, the control unit 70 includes an input-output section 71, a CPU 72, a memory 73, a detection section 74, a head driver 75, a motor driver 76, a heater controller 77, a system bus 78 and the like, and is in charge of the central control of the overall printer 100.

The input-output section 71 sends/receives data between an external apparatus (for example, a personal computer PC) and the printer 100.

The CPU 72 is an arithmetic processing unit to control the overall printer 100, and is connected to the input-output section 71, the memory 73, the detection section 74, the head driver 75, the motor driver 76, and the heater controller 77 through the system bus 78.

The memory 73 is a region for storing programs to be executed by the CPU 72, printing necessary information and the like, and is configured of a memory device such as a RAM, a ROM, a flash memory, or the like.

The CPU 72 controls the head driver 75, the motor driver 76, and the heater controller 77 in accordance with a print job (print command) received from the program stored in the memory 73, the external apparatus, or the like.

The detection section 74 is configured of a plurality of detection devices (for example, a linear encoder, a rotary encoder, an optical sensor, a temperature sensor, and the like) provided in predetermined portions inside the printer 100 such as the printing section 10, the transport section 20, the supply section 30, the winding section 40, the transport path 50, the drier 60 and the like, detects (monitors) operation states inside the printer 100, and outputs the detection results to the control unit 70. To be specific, a position of the carriage 12 that moves along the guide shaft 13 while scanning, a setting position in the width direction of the roll paper 1 in the transport path 50, a transporting state of the roll paper 1 (presence/absence of a paper jam or the like), presence/absence or a remaining amount of the roll paper 1, presence/absence or a remaining amount of ink in the printing section 10, a temperature of the drier 60, and the like are monitored.

Figure 3:
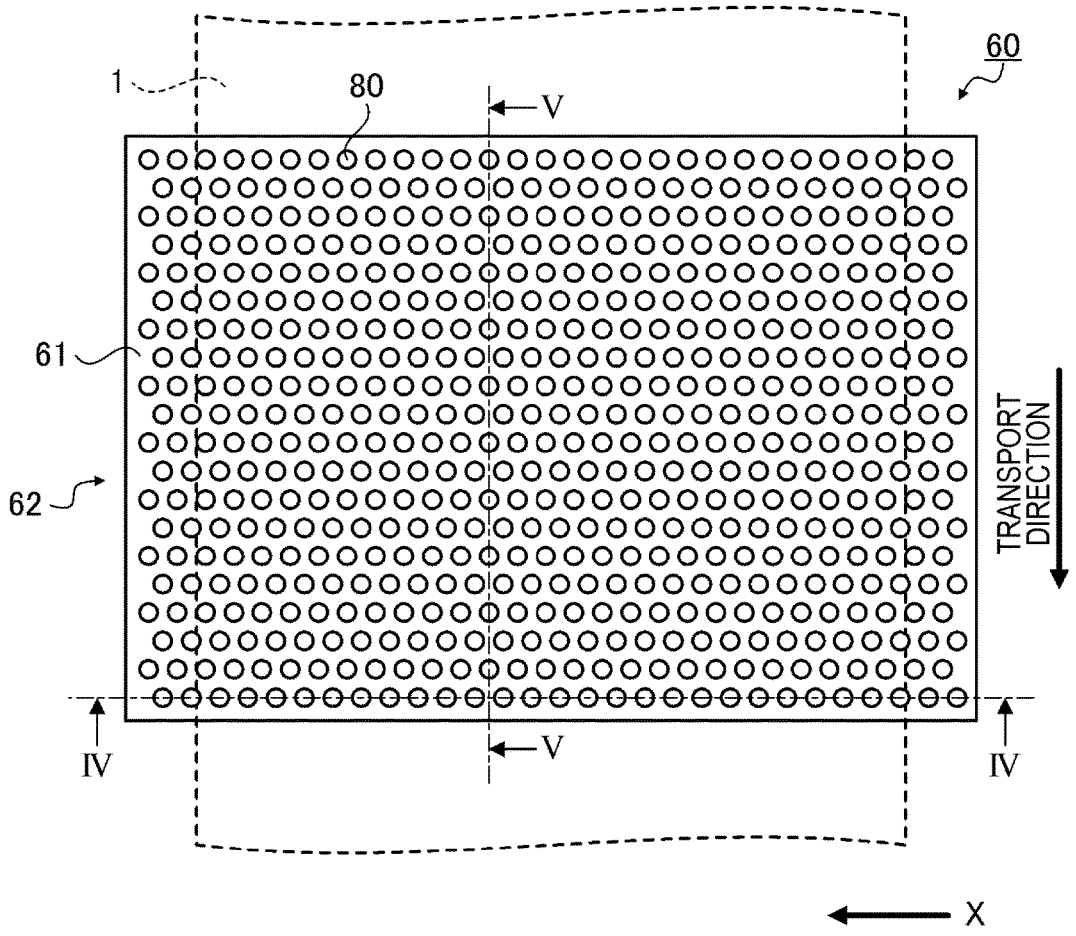
FIG. 3 is a schematic diagram for explaining a structure of a main portion of a drier.

FIG. 3 is a schematic diagram for explaining a structure of a main portion of the drier 60 according to the embodiment.

The drier 60 is configured of a hot plate 61 that supports the roll paper 1 being transported at the transport path 50 on the downstream side of the printing section 10. The hot plate 61 includes a heater 62 capable of heating the overall hot plate 61 substantially with uniformity. The heater 62 is configured of a resistance heating element and its temperature is controlled by the control unit 70 (heater controller 77).

The hot plate 61 is a plate member of which width length in the X-axis direction has a slightly longer width than a maximum width of the roll paper 1 handled by the printer 100, and is so bent as to guide the roll paper 1 from the printing section 10 to the winding section 40 under the printing section 10, as shown in FIG. 1. The roll paper 1 is heated while making slide contact with a surface of the hot plate 61, whereby the ink attached to the roll paper 1 is dried. In other words, the surface of the hot plate 61 configures a "transport surface" where a print medium (roll paper 1) on which printing has been performed is transported. Further, the heater 62 corresponds to a "heater unit" configured to heat the transport surface.

Further, the hot plate 61 includes, as shown in FIG. 3, a plurality of projections 80 with which the roll paper 1 makes slide contact in the transport surface. Note that in FIG. 3, the hot plate 61 being bent is stretched out to form and illustrate a plane extending in the transport direction (first direction) and the X-axis direction in a schematic manner.

The projection 80 is a projecting portion with its top surface (a surface with which the roll paper 1 makes slide contact) having a substantially circular shape, and the plurality of projections 80 are arranged in matrix form.

Figure 4:
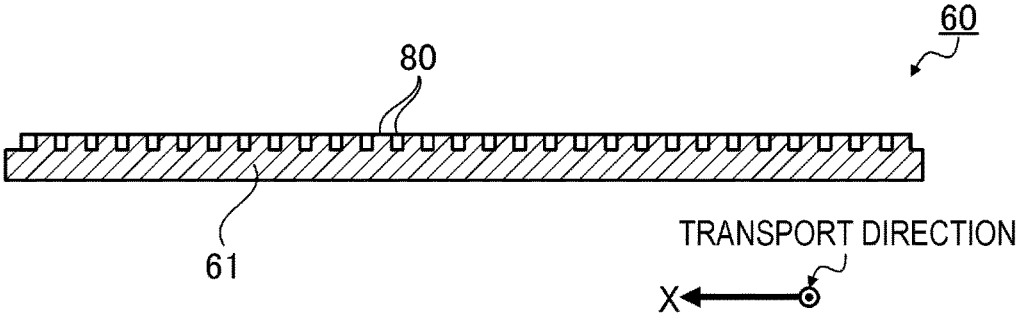
FIG. 4 is a cross-sectional view of a hot plate taken along a IV-IV line in FIG. 3.

FIG. 4 is a cross-sectional view of the hot plate 61 taken along a IV-IV line in FIG. 3, and illustrates a projective view when seen in the first direction.

The projections 80 are separated from each other in a planar view of the transport surface in the second direction (X-axis direction) intersecting with the first direction in which the roll paper 1 is transported, and are continuous in a projective view when seen in the first direction. In other words, although the plurality of projections 80 are disposed being separated from each other in the X-axis direction, they are so disposed as to be continuous in plane form in a projected view when seen in the first direction due to the projections 80 each overlapping a portion between the above separated projections. Further, the projections 80 are disposed so that, when the roll paper 1 is transported in the transport direction on the hot plate 61, an area of the top surface of the projection 80 with which the roll paper 1 makes slide contact is substantially equal to each other across the entire surface of the roll paper 1.

Figure 5:
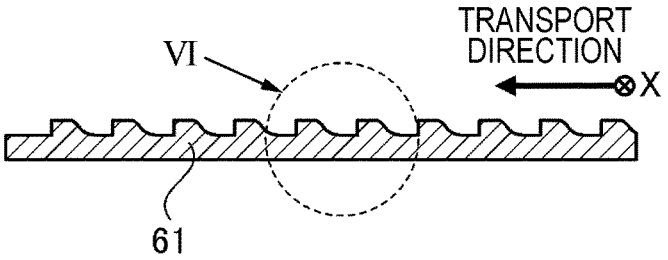
FIG. 5 is a cross-sectional view of the hot plate taken along a V-V line in FIG. 3.
Figure 6:
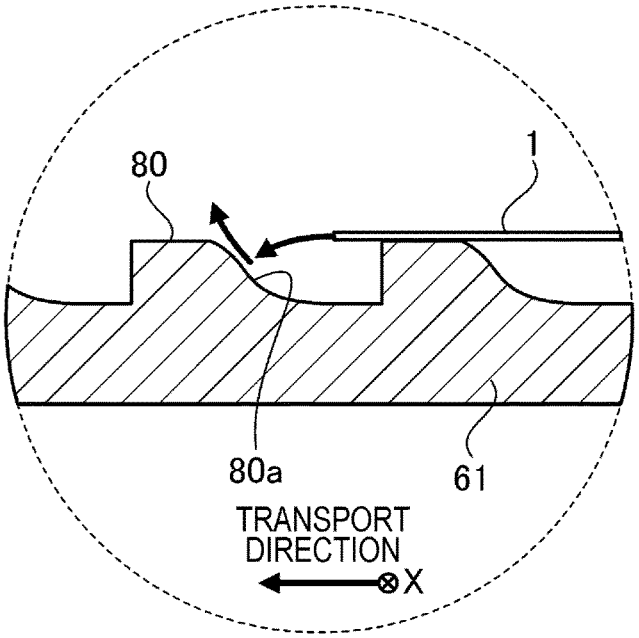
FIG. 6 is an enlarged view of a VI portion in FIG. 5.

FIG. 5 is a cross-sectional view of the hot plate 61 taken along a V-V line in FIG. 3. FIG. 6 is an enlarged view of a VI portion in FIG. 5.

A side surface 80*a* configuring the projection 80 and positioned on the opposite side to the first direction is so formed as to approach the top surface of the projection 80 with which the roll paper 1 makes slide contact as it progresses in the transport direction (first direction) of the roll paper 1.

As discussed above, with the printing apparatus according to this embodiment, the following effects can be obtained.

Because the heated transport surface (hot plate 61), on which the roll paper 1 is transported, is configured to include the plurality of projections 80 with which the roll paper 1 makes slide contact, that is, because a contact area between the roll paper 1 and the transport surface becomes small in comparison with a case of not including the projection 80, the generation of static electricity caused by friction is suppressed in comparison with a case where the roll paper 1 makes slide contact with the entirety of the transport surface with which the roll paper 1 overlaps. Moreover, the attraction due to static electricity is suppressed at the same time.

In addition, because the roll paper 1 on which printing has been performed is heated by making slide contact with (making contact with) the projections 80 of the heated transport surface, the roll paper 1 can be more efficiently dried than by hot-air heating or the like, for example.

As a result, with the structure in which the roll paper 1 is more efficiently dried by causing the roll paper 1 to make contact with the heated transport surface, the roll paper 1 can be smoothly transported (discharged) while suppressing the attraction of the roll paper 1 to the transport surface due to the static electricity.

Further, because the projections 80 of the heated transport surface are so configured as to be continuous in the second direction (X-axis direction) intersecting with the first direction in which the roll paper 1 is transported in a projective view when seen in the first direction in which the roll paper 1 is transported, the entire surface of the roll paper 1 makes slide contact with one of the projections 80 by the roll paper 1 passing through the transport surface. In other words, because the entire surface of the roll paper 1 makes contact with the projections 80 of the heated transport surface, drying operation in which uneven drying is decreased can be carried out.

Furthermore, the side surface 80*a* configuring the projection 80 and positioned on the opposite side to the first direction is so formed as to approach the top surface with which the roll paper 1 makes slide contact as it progresses in the first direction (the transport direction of the roll paper 1). That is, even if an end portion of the roll paper 1 being transported in the first direction makes contact with the side surface configuring the projection 80 and positioned on the opposite side to the first direction, the side surface 80*a* of the projection 80 functions as a rake-face for scooping up the end portion of the roll paper 1, whereby the roll paper 1 can be smoothly transported (discharged) without being caught.

Second Embodiment

Next, a printing apparatus according to a second embodiment will be described. It is to be noted that the same constituent elements as those described in the above embodiment are assigned the same reference numerals and redundant description thereof will be omitted herein.

In the first embodiment, it is described that the hot plate 61 includes the plurality of projections 80 with which the roll paper 1 makes slide contact in the transport surface as shown in FIG. 3. Meanwhile, the second embodiment is characterized in that a transport surface includes a plurality of recesses.

Figure 7:
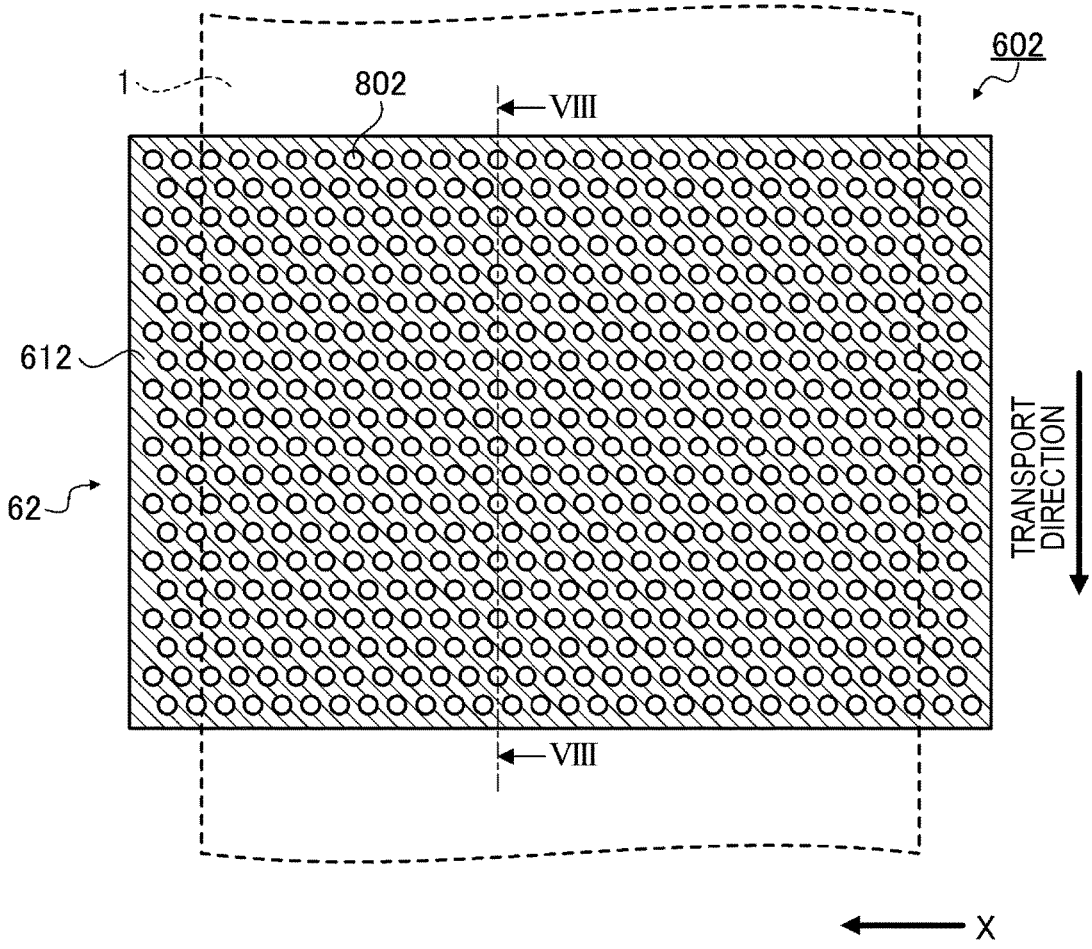
FIG. 7 is a schematic diagram for explaining a structure of a main portion of a drier included in a printer according to a second embodiment.

FIG. 7 is a schematic diagram for explaining a structure of a main portion of a drier 602 included in a printer 1002 (not shown) according to the second embodiment.

The printer 1002 includes the drier 602 in place of the drier 60 included in the printer 100. Except for this point, the printer 1002 is the same as the printer 100.

The drier 602 is configured of a hot plate 612 that supports the roll paper 1 being transported through the transport path 50 on the downstream side of the printing section 10. The hot plate 612 includes the heater 62 capable of heating the overall hot plate 612 substantially with uniformity.

The hot plate 612 is a plate member having a slightly longer width than the width (length in the X-axis direction) of the roll paper 1 handled by the printer 1002, and is so bent as to guide the roll paper 1 from the printing section 10 to the winding section 40 under the printing section 10, like the hot plate 61. The roll paper 1 is heated while making slide contact with a surface of the hot plate 612, whereby the ink attached to the roll paper 1 is dried. In other words, the surface of the hot plate 612 configures a "transport surface" where a print medium (roll paper 1) on which printing has been performed is transported. Further, the heater 62 corresponds to a "heater unit" configured to heat the transport surface.

Further, the hot plate 612 includes, as shown in FIG. 7, a plurality of recesses 802 in the transport surface with which the roll paper 1 makes slide contact. Note that in FIG. 7, the hot plate 612 being bent is stretched out to form and illustrate a plane extending in the transport direction (first direction) and the X-axis direction in a schematic manner.

A shape of an aperture surface of the recess 802 is substantially circular, and the plurality of recesses 802 are arranged in matrix form.

Figure 8:
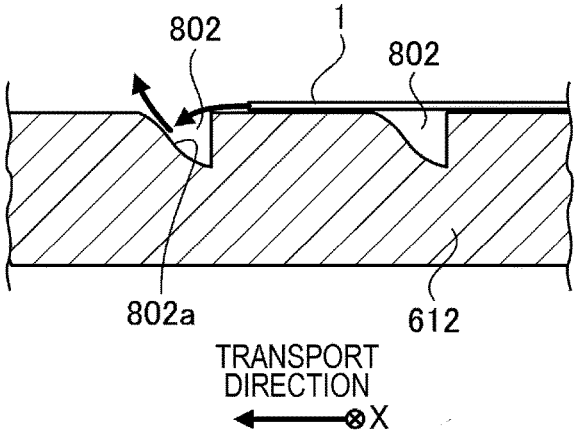
FIG. 8 is an enlarged cross-sectional view in which a cross-section of a hot plate taken along a VIII-VIII line in FIG. 7 is enlarged and illustrated.

FIG. 8, which corresponds to FIG. 6 of the first embodiment, is an enlarged cross-sectional view in which a cross-section of the hot plate 612 taken along a VIII-VIII line in FIG. 7 is enlarged and illustrated.

A side surface 802*a* configuring the recess 802 and positioned on the first direction side is so formed as to approach the transport surface with which the roll paper 1 makes slide contact as it progresses in the transport direction (first direction) of the roll paper 1.

With the printing apparatus according to this embodiment, because the heated transport surface on which the roll paper 1 is transported while making slide contact therewith is so configured as to include the plurality of recesses 802, an area where the roll paper 1 makes slide contact, that is, a contact area between the roll paper 1 and the transport surface becomes smaller. With this, the generation of static electricity caused by friction is suppressed in comparison with a case where the roll paper 1 makes slide contact with the entirety of the transport surface with which the roll paper 1 overlaps. In addition, the attraction due to static electricity is suppressed at the same time.

Further, because the roll paper 1 on which printing has been performed is heated by making slide contact with (making contact with) the surface (transport surface) of the heated hot plate 612, the roll paper 1 can be more efficiently dried.

As a result, with the structure in which the roll paper 1 is more efficiently dried by causing the roll paper 1 to make contact with the heated transport surface, the roll paper 1 can be smoothly transported (discharged) while suppressing the attraction of the roll paper 1 to the transport surface due to the static electricity.

Furthermore, the side surface 802*a* configuring the recess 802 and positioned on the first direction side is so formed as to approach the transport surface with which the roll paper 1 makes slide contact as it progresses in the first direction (the transport direction of the roll paper 1). That is, even if an end portion of the roll paper 1 being transported in the first direction makes contact with the side surface 802*a* configuring the recess 802 and positioned on the first direction side, the side surface 802*a* of the recess 802 functions as a rake-face for scooping up the end portion of the roll paper 1, whereby the roll paper 1 can be smoothly transported (discharged).

Third Embodiment

Next, a printing apparatus according to a third embodiment will be described. It is to be noted that the same constituent elements as those described in the above embodiments are assigned the same reference numerals and redundant description thereof will be omitted herein.

In the first embodiment, as shown in FIG. 3, it is described that the hot plate 61 includes the plurality of projections 80 with which the roll paper 1 makes slide contact in the transport surface, each of the projections 80 is a projecting portion whose top surface (a surface with which the roll paper 1 makes slide contact) is formed in a substantially circular shape, and the plurality of projections 80 are arranged in matrix form. Meanwhile, the third embodiment is characterized in that a projection is so formed as to extend both in a direction intersecting with the first direction in which the roll paper 1 is transported and in a direction intersecting with a direction orthogonal to the first direction in a planar view of the transport surface.

Figure 9:
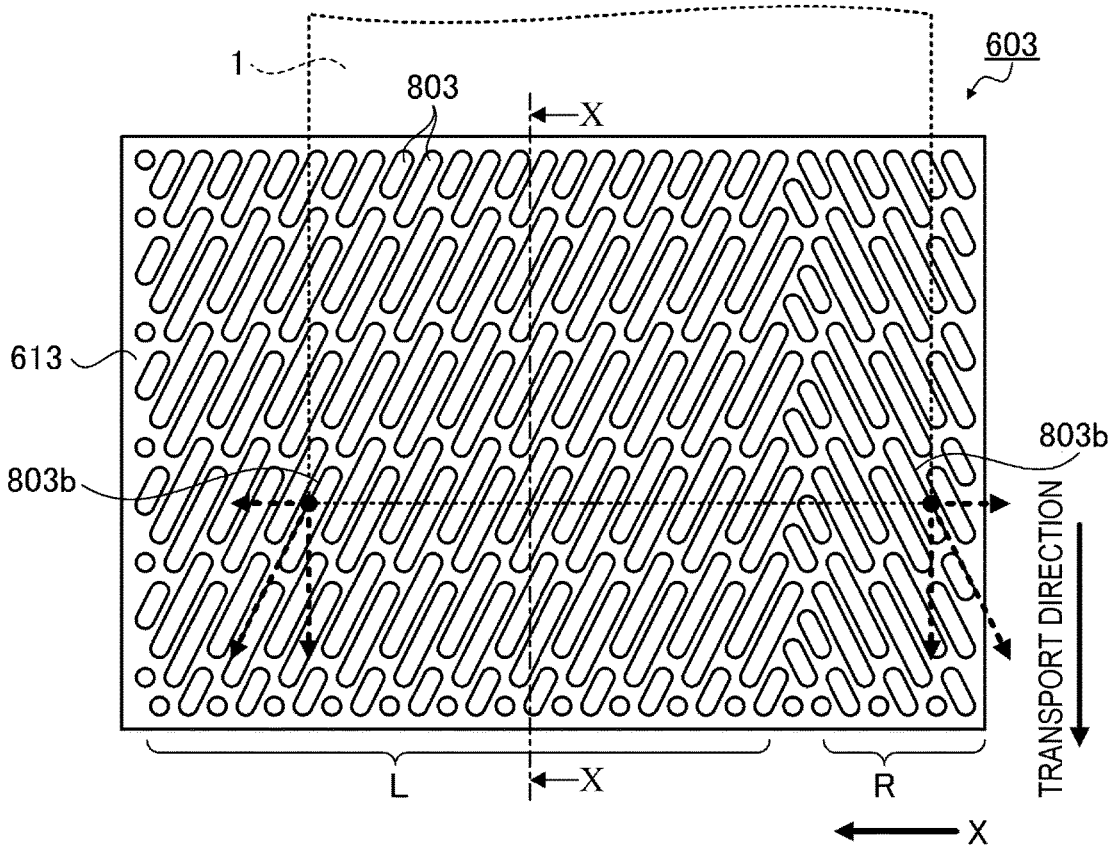
FIG. 9 is a schematic diagram for explaining a structure of a main portion of a drier included in a printer according to a third embodiment.

FIG. 9 is a schematic diagram for explaining a structure of a main portion of a drier 603 included in a printer 1003 (not shown) according to the third embodiment.

The printer 1003 includes the drier 603 in place of the drier 60 included in the printer 100. Except for this point, the printer 1003 is the same as the printer 100.

The drier 603 is configured of a hot plate 613 that supports the roll paper 1 being transported through the transport path 50 on the downstream side of the printing section 10. The hot plate 613 includes the heater 62 capable of heating the overall hot plate 613 substantially with uniformity.

The hot plate 613 is a plate member having a slightly longer width than the width (length in the X-axis direction) of the roll paper 1 handled by the printer 1003, and is so bent as to guide the roll paper 1 from the printing section 10 to the winding section 40 under the printing section 10, like the hot plate 61. The roll paper 1 is heated while making slide contact with a surface of the hot plate 613, whereby the ink attached to the roll paper 1 is dried. In other words, the surface of the hot plate 613 configures a "transport surface" where a print medium (roll paper 1) on which printing has been performed is transported. Further, the heater 62 corresponds to a "heater unit" configured to heat the transport surface.

Further, the hot plate 613 includes, as shown in FIG. 9, a plurality of projections 803 in the transport surface with which the roll paper 1 makes slide contact. Note that in FIG. 9, the hot plate 613 being bent is stretched out to form and illustrate a plane extending in the transport direction (first direction) and the X-axis direction in a schematic manner.

Each of the projections 803 is so formed as to extend, in a planar view of the transport surface, both in a direction intersecting with the first direction in which the roll paper 1 is transported and in a direction intersecting with a direction orthogonal to the first direction, that is, the projection is so formed as to extend in an oblique direction in the transport surface.

More specifically, the projection 803 is so formed as to extend toward a negative X side as it progresses in the transport direction in a region of the hot plate 613 on the negative X side (a region R in FIG. 9), and extend toward a positive X side as it progresses in the transport direction in a region of the hot plate 613 on the positive X side (a region L shown in FIG. 9).

The printer 1003 can perform printing on the roll paper 1 of a different width, and the roll paper 1 is set taking the negative X side as a reference position in the transport path 50 when the roll paper 1 is set in the printer 1003. In other words, as for the roll paper 1 of a different width, an end portion of the roll paper 1 on the negative X side is always positioned in the region R when the roll paper 1 passes through on the hot plate 613. Meanwhile, an end portion thereof on the positive X side is always positioned in the region L.

As such, when an end portion of the roll paper 1 is transported as indicated by a broken line in FIG. 9, in the case where a corner of an end on the first direction side of the roll paper 1 makes contact with a surface 803*b* extending in an oblique direction, the corner of the roll paper 1 is biased in a direction toward an outer side of the roll paper 1; note that the surface 803*b* is included in a side surface 803*a* of the projection 803 positioned on the opposite side to the first direction.

In other words, the structure is such that the side surface 803*a* configuring the projection 803 and positioned on the opposite side to the first direction includes a guide surface (surface 803*b*) by which, in the case where a corner of an end on the first direction side of the roll paper 1 being transported in the first direction makes contact with the stated guide surface, the corner thereof is biased in a direction toward the outer side of the roll paper 1 in the second direction.

Figure 10:
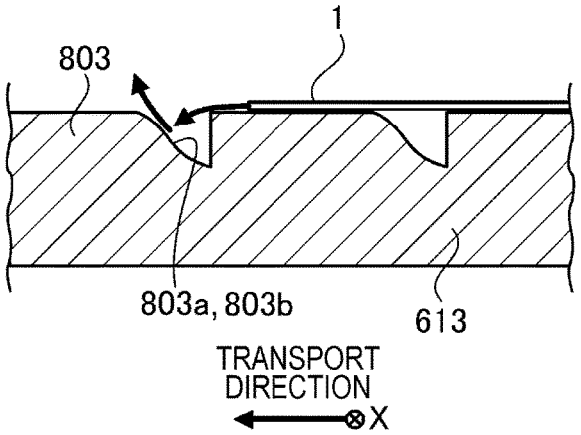
FIG. 10 is an enlarged cross-sectional view in which a cross-section of a hot plate taken along a X-X line in FIG. 9 is enlarged and illustrated.

FIG. 10, which corresponds to FIG. 6 of the first embodiment, is an enlarged cross-sectional view in which a cross-section of the hot plate 613 taken along a X-X line in FIG. 9 is enlarged and illustrated.

The side surface 803*a* configuring the projection 803 and positioned on the opposite side to the first direction is so formed as to approach the transport surface with which the roll paper 1 makes slide contact as it progresses in the transport direction (first direction) of the roll paper 1.

In other words, the side surface 803*a* shown in FIG. 10 is a surface that functions as a rake-face for scooping up an end portion of the roll paper 1 in the case where the end portion of the roll paper 1 being transported in the first direction makes contact with the side surface 803*a* configuring the projection 803 and positioned on the opposite side to the first direction, and is also a surface that functions as the guide surface (surface 803*b*) by which, in the case where a corner of an end on the first direction side of the roll paper 1 being transported in the first direction makes contact with the above guide surface, the corner is biased in a direction toward the outer side of the roll paper 1 in the second direction.

An end portion of the roll paper 1 in the transport direction is cut in parallel to the X-axis direction in many cases. In such case, if the projection 803 is so formed as to extend in parallel to the X-axis direction, the end portion of the roll paper 1 in the transport direction is likely to be caught by the projection. In contrast, in the printing apparatus according to this embodiment, the projection 803 is so formed as to extend, in a planar view of the transport surface, both in a direction intersecting with the first direction in which the roll paper 1 is transported and in a direction intersecting with a direction orthogonal to the first direction, that is, the projection 803 is so formed as to extend in an oblique direction in the transport surface. With this, a situation where the end portion of the roll paper 1 being transported is caught by the side surface 803*a* configuring the projection 803 and positioned on the opposite side to the first direction is suppressed, thereby making it possible to smoothly transport (discharge) the roll paper 1.

Further, the side surface 803*a* configuring the projection 803 and positioned on the opposite side to the first direction includes the guide surface by which, in the case where a corner of an end on the first direction side of the roll paper 1 being transported in the first direction makes contact with the guide surface, the corner is biased in a direction toward the outer side of the roll paper 1 in the second direction. That is, even if a corner of an end portion of the roll paper 1 being transported in the first direction makes contact with the side surface 803*a* configuring the projection 803 and positioned on the opposite side to the first direction, in the case where the side surface 803*a* with which the corner thereof makes contact is the above-mentioned guide surface, the corner of the end portion of the roll paper 1 is biased in a direction toward the outer side of the roll paper 1, whereby the roll paper 1 can be smoothly transported (discharged) without the corner of the roll paper 1 being caught.

Moreover, the side surface 803*a* configuring the projection 803 and positioned on the opposite side to the first direction is so formed as to approach the transport surface with which the roll paper 1 makes slide contact as it progresses in the first direction (the transport direction of the roll paper 1). That is, even if an end portion of the roll paper 1 being transported in the first direction makes contact with the side surface 803*a* configuring the projection 803 and positioned on the opposite side to the first direction, the side surface 803*a* of the projection 803 functions as a rake-face for scooping up the end portion of the roll paper 1, whereby the roll paper 1 can be smoothly transported (discharged).

Fourth Embodiment

Next, a printing apparatus according to a fourth embodiment will be described. It is to be noted that the same constituent elements as those described in the above embodiments are assigned the same reference numerals and redundant description thereof will be omitted herein.

Although such an example is described in the third embodiment that the projection is so formed as to extend, in a planar view of the transport surface, both in a direction intersecting with the first direction in which the roll paper 1 is transported and in a direction intersecting with a direction orthogonal to the first direction (in other words, in an oblique direction), a recess may be so formed as to extend both in a direction intersecting with the first direction in which the roll paper 1 is transported and in a direction intersecting with a direction orthogonal to the first direction (in other words, in an oblique direction).

Figure 11:
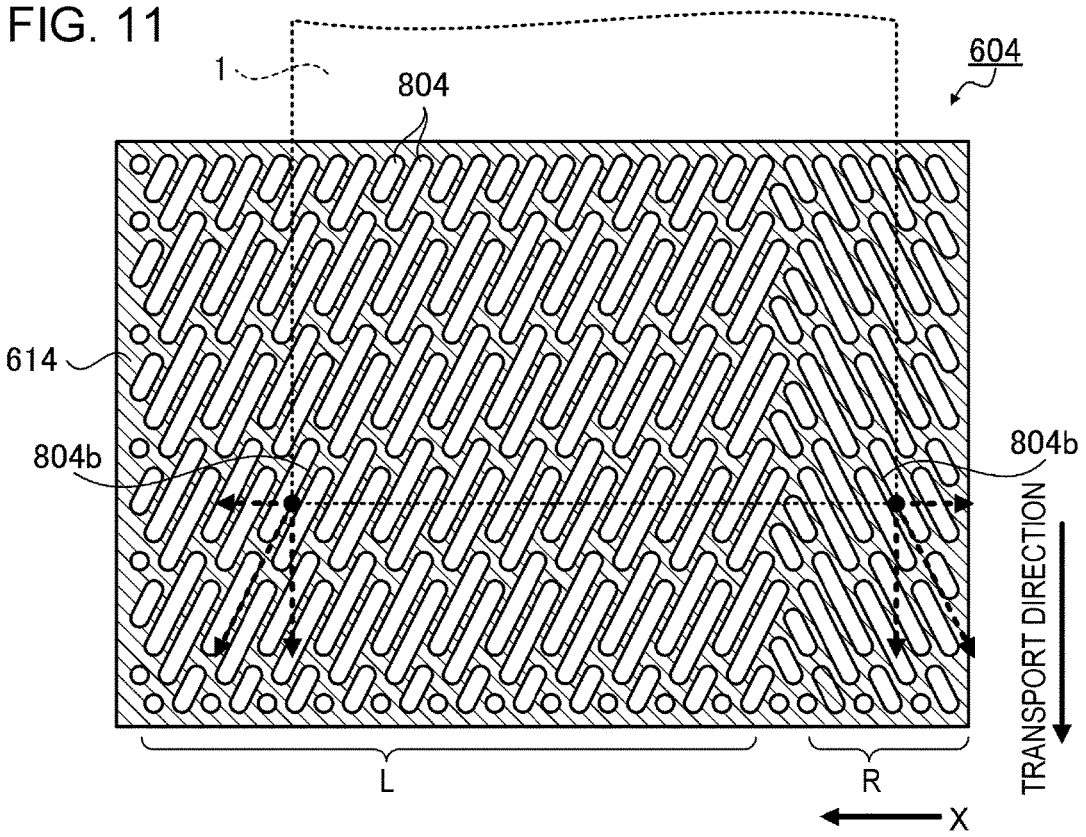
FIG. 11 is a schematic diagram for explaining a structure of a main portion of a drier included in a printer according to a fourth embodiment.

FIG. 11 is a schematic diagram for explaining a structure of a main portion of a drier 604 included in a printer 1004 (not shown) according to the fourth embodiment.

The drier 604 is configured of a hot plate 614, and the hot plate 614 includes the heater 62 capable of heating the overall hot plate 614 substantially with uniformity.

The hot plate 614 includes, as shown in FIG. 11, a plurality of recesses 804 in a transport surface with which the roll paper 1 makes slide contact.

The recess 804 is so formed as to extend, in a planar view of the transport surface, both in a direction intersecting with the first direction in which the roll paper 1 is transported and in a direction intersecting with a direction orthogonal to the first direction.

Like the recess 802 (see FIG. 8) described in the second embodiment, a side surface configuring the recess 804 and positioned on the first direction side (transport direction side) is so formed as to approach the transport surface with which the roll paper 1 makes slide contact as it progresses in the first direction (transport direction). In addition, the side surface configuring the recess 804 and positioned on the first direction side includes a guide surface (surface 804*b*) by which, in the case where a corner of an end on the first direction side of the roll paper 1 being transported in the first direction makes contact with the guide surface, the corner is biased in a direction toward the outer side of the roll paper 1 in the second direction.

According to this embodiment, the recess 804 is so formed as to extend, in a planar view of the transport surface, both in a direction intersecting with the first direction in which the roll paper 1 is transported and in a direction intersecting with a direction orthogonal to the first direction, that is, the recess 804 is so formed as to extend in an oblique direction in the transport surface. With this, a situation where an end portion of the roll paper 1 being transported is stuck in the recess 804 is suppressed, thereby making it possible to smoothly transport (discharge) the roll paper 1.

Further, the side surface configuring the recess 804 and positioned on the first direction side is so formed as to approach the transport surface with which the roll paper 1 makes slide contact as it progresses in the first direction (the transport direction of the roll paper 1). That is, even if an end portion of the roll paper 1 being transported in the first direction makes contact with the side surface configuring the recess 804 and positioned on the first direction side, the side surface of the recess 804 functions as a rake-face for scooping up the end portion of the roll paper 1, whereby the roll paper 1 can be smoothly transported (discharged).

Furthermore, the side surface configuring the recess 804 and positioned on the first direction side includes the guide surface by which, in the case where a corner of an end on the first direction side of the roll paper 1 being transported in the first direction makes contact with the guide surface, the corner thereof is biased in a direction toward the outer side of the roll paper 1 in the second direction. That is, even if a corner of an end portion of the roll paper 1 being transported in the first direction makes contact with the side surface configuring the recess 804 and positioned on the first direction side, in the case where the side surface with which the corner thereof makes contact is the above-mentioned guide surface, the corner of the end portion of the roll paper 1 is biased in a direction toward the outer side of the roll paper 1, whereby the roll paper 1 can be smoothly transported (discharged).

It is to be noted that the invention is not limited to the above-discussed embodiments, and various kinds of modifications or improvements can be made on the above embodiments. Hereinafter, variations will be described. Note that the same constituent elements as those described in the above embodiments are assigned the same reference numerals and redundant description thereof is omitted herein.

First Variation

Figure 12:
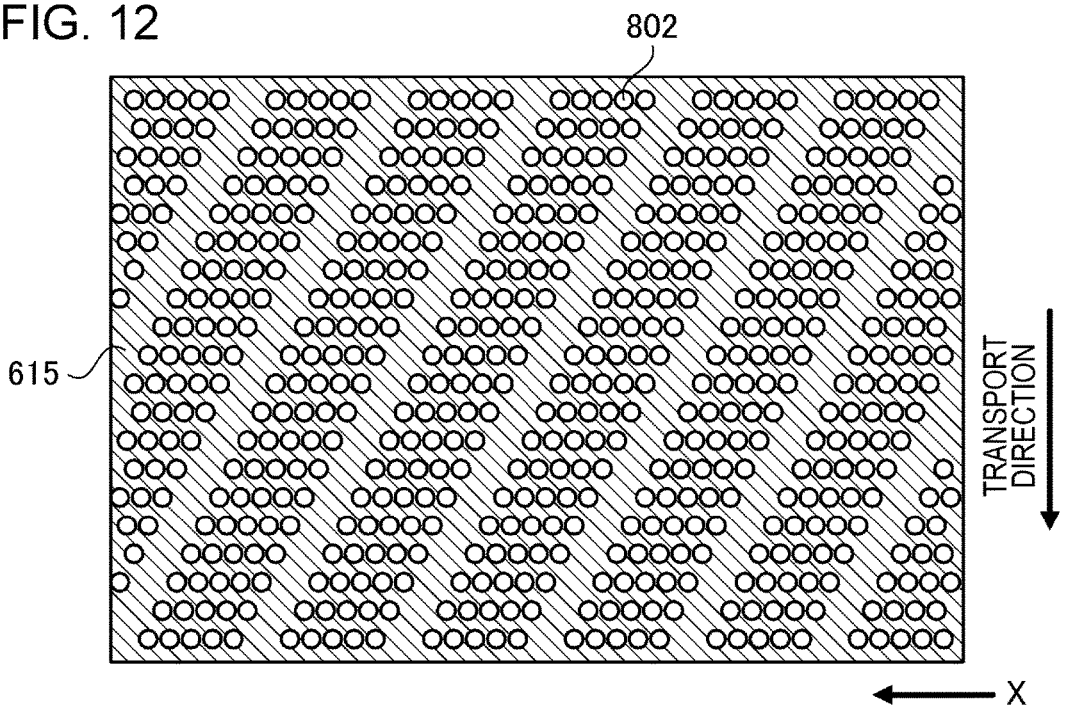
FIG. 12 is a schematic diagram illustrating a structure of a hot plate according to a first variation.

FIG. 12 is a schematic diagram illustrating a structure of a hot plate 615 according to a first variation.

In the second embodiment, it is described that the shape of the aperture surface of the recess 802 is substantially circular, and the plurality of recesses 802 are arranged in matrix form, as shown in FIG. 7. However, as long as the recesses 802 are disposed so that an area of the transport surface with which the roll paper 1 makes slide contact is substantially equal to each other across the entire surface of the roll paper 1 when the roll paper 1 is transported on the hot plate in the transport direction, the arrangement of the recesses 802 is not limited to the matrix form.

For example, as shown in FIG. 12, the arrangement may be such that a region where the recesses 802 are densely arranged and a region where the recesses 802 are not arranged or sparsely arranged are alternately disposed.

With this structure, for example, along with the transport of the roll paper 1, in the case where it is intended to cause a period of time in which the roll paper 1 is heated while continuously making slide contact to be equal to or longer than a predetermined time or the like, the lengthened period of time can be obtained by additionally providing the regions where the recesses 802 are not arranged in accordance with an amount of time to be lengthened.

It is preferable that the arrangement, area, and so on of a region where the recesses 802 are not arranged or a region where the recesses 802 are sparsely arranged undergo sufficient evaluation including the evaluation of the rigidity of the roll paper 1, the structure of the transport route, the transport method, the transport accuracy, and so on while considering the attraction due to static electricity generated by the roll paper 1 making slide contact.

The recess provided in the transport surface in the above-discussed embodiments may not be a recess, but may be configured with a hole passing through a hot plate, for example.

This application claims priority under 35 U.S.C. § 119 to Japanese Patent Application No. 2016-041858, filed Mar. 4, 2016. The entire disclosure of Japanese Patent Application No. 2016-041858 is hereby incorporated herein by reference.

What is claimed is:

1. A printing apparatus comprising:

a printing section configured to perform printing on a print medium;

a transport surface where the print medium on which printing has been performed is transported; and a heater unit for heating the transport surface, wherein the transport surface includes a plurality of projections with which the print medium makes slide contact, wherein a top surface of each of the projections is separated from the top surfaces of the other projections in a planar view of the transport surface in a second direction intersecting with a first direction in which the print medium is transported, and wherein the top surfaces are continuous in a projective view when seen in the first direction.

2. The printing apparatus according to claim 1, wherein a side surface configuring the projection and positioned on an opposite side to the first direction is formed so as to approach the top surface of each of the projections with which the print medium makes slide contact as the print medium progresses in the first direction.

3. The printing apparatus according to claim 1, wherein each of the projections is formed so as to extend both in a direction intersecting with the first direction in which the print medium is transported and in a direction intersecting with a direction orthogonal to the first direction in a planar view of the transport surface.

4. The printing apparatus according to claim 1, wherein a side surface configuring each of the projections and positioned on the opposite side to the first direction includes a guide surface by which, in a case where a corner of an end on the first direction side of the print medium being transported in the first direction makes contact with the stated guide surface, the corner is biased in a direction toward an outer side of the print medium in the second direction.

5. The printing apparatus of claim 1, wherein at least some of the projections have a length that is greater than a width and wherein the projections extend in an oblique direction on the transport surface.

6. The printing apparatus of claim 1, wherein a shape of a surface of the projections is substantially circular.

7. A printing apparatus comprising:

a printing section configured to perform printing on a print medium;

a transport surface where the print medium on which printing has been performed is transported while making slide contact with the transport surface; and a heater unit for heating the transport surface, wherein the transport surface includes a plurality of recesses, wherein a side surface configuring each of the recesses is positioned on the side of a first direction in which the print medium is transported, wherein the side surface is formed so as to approach the transport surface with which the print medium makes slide contact as the print medium progresses in the first direction.

8. The printing apparatus according to claim 7, wherein each of the recesses is formed so as to extend both in a direction intersecting with the first direction in which the print medium is transported and in a direction intersecting with a direction orthogonal to the first direction in a planar view of the transport surface.

9. The printing apparatus according to claim 7, wherein the side surface configuring each of the recesses and positioned on the first direction side includes a guide surface by which, in the case where a corner of an end on the first direction side of the print medium being transported in the first direction makes contact with the stated guide surface, the corner is biased in a direction toward an outer side of the print medium in a second direction intersecting with the first direction.

10. The printing apparatus of claim 7, wherein the recesses have a length that is greater than a width and wherein the recesses extend in an oblique direction on the transport surface.

11. The printing apparatus of claim 7, wherein a shape of an aperture surface of the recesses is substantially circular.

12. A printing apparatus comprising:

a printing section configured to perform printing on a print medium;

a transport surface where the print medium on which printing has been performed is transported; and a heater unit for heating the transport surface, wherein the transport surface includes a plurality of projections with which the print medium makes slide contact, wherein the projections are separated from each other in a planar view of the transport surface in a second direction intersecting with a first direction in which the print medium is transported, and are continuous in a projective view when seen in the first direction, wherein a side surface configuring the projection and positioned on an opposite side to the first direction is formed so as to approach a top surface of each of the projections with which the print medium makes slide contact as the print medium progresses in the first direction.

13. The printing apparatus according to claim 12, wherein each of the projections is formed so as to extend both in a direction intersecting with the first direction in which the print medium is transported and in a direction intersecting with a direction orthogonal to the first direction in a planar view of the transport surface.

14. The printing apparatus according to claim 12, wherein a side surface configuring each of the projections and positioned on the opposite side to the first direction includes a guide surface by which, in a case where a corner of an end on the first direction side of the print medium being transported in the first direction makes contact with the stated guide surface, the corner is biased in a direction toward an outer side of the print medium in the second direction.

* * * * *